United States Patent [19]

Strunck et al.

[11] Patent Number: 4,557,808

[45] Date of Patent: Dec. 10, 1985

[54] METHOD OF APPLYING A CORROSION-PROOF AND WEAR-RESISTANT COATING TO A WORKPIECE

[75] Inventors: Theo Strunck, Werne; Erich Fricke, Kamen-Methler, both of Fed. Rep. of Germany

[73] Assignee: Gewerkschaft Eisenhutte Westfalia, Lunen, Fed. Rep. of Germany

[21] Appl. No.: 498,165

[22] Filed: May 25, 1983

[30] Foreign Application Priority Data

Jun. 2, 1982 [DE] Fed. Rep. of Germany ..... 3220723

[51] Int. Cl.[4] ..... C25D 5/40

[52] U.S. Cl. ..... 204/29; 204/32.1; 204/38.4; 204/144.5

[58] Field of Search ..... 204/29, 32 R, 38 B, 204/141.5, 144.5; 427/307, 405, 438

[56] References Cited

U.S. PATENT DOCUMENTS

| | | | |
|---|---|---|---|
| 3,644,183 | 2/1972 | Odekerken | 204/38 B |
| 3,654,099 | 4/1972 | De Bruyne | 204/29 |
| 4,416,738 | 11/1983 | Herrmann, Jr. | 204/32 R |

OTHER PUBLICATIONS

Metal Finishing Guidebook and Directory for 1978, Metals and Plastics Publications, Inc., Hackensack, N.J., pp. 168–169, 173.

*Primary Examiner*—Andrew H. Metz
*Assistant Examiner*—William T. Leader
*Attorney, Agent, or Firm*—Maurice E. Gauthier

[57] ABSTRACT

The invention is directed to a method of applying a corrosion-proof and wear-resistant coating to the piston rod of a hydraulic ram which is intended to be used in an underground mine working, or in similar workings. The method comprises the steps of applying a layer of nickel to the piston rod using a currentless nickel-plating process, and then applying a microcracked hard-chromium layer to the nickel layer. The nickel layer is of high density, tensile strength and ductility. Before the application of the microcracked hard-chromium layer, the previously-applied nickel layer is activated electrolytically in a sulphuric acid bath, in order to improve the adhesion of the hard-chromium layer to the nickel layer.

17 Claims, No Drawings

METHOD OF APPLYING A CORROSION-PROOF AND WEAR-RESISTANT COATING TO A WORKPIECE

BACKGROUND OF THE INVENTION

The invention relates to a method of applying a corrosion-proof and wear-resistant coating to a workpiece, and in particular to the piston rod of a hydraulic ram of the type used in underground mining operations or in tunnel driving.

It is well known that galvanic or currentlessly-precipitated coatings of a metal are usually effective only against specific corrosives. It is also known to coat the piston rods of hydraulic pit props (or other hydraulic rams used in underground mining) with chromium using the hard plating process. Such a chromium coating layer is relatively brittle, so that the danger exists that, in use, it may break. Consequently, it is usual to apply galvanically a substantially crack-free chromium layer to the piston rod prior to applying the chromium plating using the hard plating process. The galvanically-applied layer forms an underlayer for the coating, which takes the form of a microcracked hard-chromium layer. Hydraulic rams provided with such a combined protective coating have proved their value in mining operations. The hard-chromium plating is distinguished by high wear resistance, and also by stability to corrosion in a reducing corrosive medium (such as a sulphur dioxide industrial atmosphere). On the other hand, the corrosion stability of the hard-chromium plating in relation to an oxidising atmosphere (and especially in relation to a chloride-containing atmosphere) is inadequate. Here, under certain conditions (such as are to be encountered in underground mining), serious damage can occur to the hard-chromium-plated parts, as early as within a few days or weeks. In particular heavy pitting can occur, so that damaged props and rams have to be taken out of use and replaced.

There is a tendency for protection against a predominantly reducing atmosphere to lose importance in underground mining. For some time, pit atmospheres have been modified towards a chloride-containing oxidising atmosphere. This is attributable to various influencing factors, but mainly to the intensification of the measures for combatting dust in underground workings.

Until now, it has not been possible to develop a protective coating for props (and other hydraulic rams), which coating has high wear-resistance and is corrosion-proof in relation to both a reducing atmosphere and a chloride-containing oxidising atmosphere.

It is known to apply a single-layer or multi-layer protective nickel coating to the piston rods of pit props (or other hydraulic rams) using the known currentless nickel-coating process. This process is based upon a reduction of the nickel ions present in the nickel bath using a suitable reducing agent. The known hypophosphite process, in which a hypophosphite (such as sodium hypophosphite) is used as a reducing agent, has proved its value especially well here. With this process, it is possible to form protective coatings, with a variable phosphorus content, which are distinguished by high density and extensive pore-free quality, and also by relatively high hardness, tensile strength and breaking elongation (ductility). These currentlessly-applied protective nickel coatings are also corrosion-proof in relation to a chloride-containing oxidising atmosphere. Unfortunately, their corrosion resistance in relation to a reducing sulphur dioxide atmosphere is inadequate.

Attempts to apply a wear-resistant, hard-chromium coating to a currentlessly-applied nickel underlayer have hitherto been unsuccessful, since the adhesion of the hard-chromium coating upon the nickel layer is inadequate. Consequently, in use, the hard chromium coating tends to flake away from the nickel layer.

The aim of the invention is to produce coatings for the piston rods of pit props (or other hydraulic rams) which have high wear resistance, and display a high corrosion stability both in relation to a reducing atmosphere and in relation to an oxidising chloride-containing atmosphere.

SUMMARY OF THE INVENTION

The present invention provides a method of applying a corrosion-proof and wear-resistant coating to a workpiece, the method comprising the steps of applying a layer of nickel to the workpiece by a currentless nickel-plating process, activating the nickel layer electrolytically in a sulphuric acid bath, and coating the activated nickel layer by a chromium plating process.

Surprisingly, it is possible to achieve a satisfactory adhesion of the chromium coating (which is microcracked) upon the nickel layer without the hydrogen (which forms during the activation in the sulphuric acid bath and reduces the nickel oxides on the surface of the nickel layer) diffusing into the nickel layer, and disadvantageously, modifying the mechanical properties of the nickel layer, especially its density, tensile strength and flexibility (ductility). The protective coating achieved in accordance with the invention is adequate for the high mechanical stresses to which the piston rod of a pit prop (or other hydraulic ram) is exposed in use. With regard to the stability of the protective coating in relation to a chloride-containing oxidising atmosphere, the nickel underlayer has high density, is substantially pore-free, and has adequate high ductility and tensile strength.

Advantageously, a hypophosphite (such as sodium hypophosphite) is used as a reducing agent during the nickel-plating process. This enables a variable amount of phosphorus to be alloyed with the nickel.

The combined nickel/chromium coating formed in this way has an excellent corrosion stability, even under the conditions which prevail in underground mine workings. Although the nickel layer is not stable in a reducing atmosphere, the nickel/chromium coating has an excellent stability in relation to this atmosphere. Moreover, the nickel/chromium coating is also stable in a chloride-containing oxidising atmosphere. The chromium covering of the nickel/chromium coating also constitutes a wear-protective layer for the softer nickel layer. This chromium layer does not flake away from the nickel layer under mechanical stresses. Consequently, where the workpiece is the piston rod of a hydraulic prop (or other hydraulic ram) there are no problems with flaking in the atmospheres that prevail in underground mine workings.

Currentless nickel-plating by the so-called hypophosphite process (using sodium hypophosphite as reducing agent) is, as mentioned, well known. The fundamental properties of such a process can be seen, for example, from the printed document "Currentless thick nickel-plating according to the "Kanigen", "Durni-Coat" and "Nibodur" processes" of International Nickel (January 1971).

In a preferred embodiment, the activation of the nickel layer is carried out in a sulphuric acid bath which has 5 to 20% by volume, preferably about 10% by volume, sulphuric acid at a temperature of between 25° C. and 60° C., preferably about 50° C., and with a current density of between 10 and 60 A/sq.dm., preferably about 30 to 40 A/sq./dm.

Advantageously, the workpiece provided with the nickel layer is introduced into the sulphuric acid bath prior to switching on the current, and the current is switched on for carrying out cathodic polarisation in the electrolytic sulphuric acid bath only after a predetermined time of at least 2 minutes, and preferably about 3 minutes. Preferably, during cathodic polarisation in the sulphuric acid bath, the current flow is briefly interrupted at least once, the or each interruption of current flow lasting for between 3 and 5 seconds.

In a preferred embodiment, after the current is switched on, cathodic polarisation is carried out for about 2 to 3 minutes, then the current flow is interrupted for between 3 and 5 seconds, and then cathodic polarisation is carried out for about 2 to 3 minutes.

Advantageously, after activation, the workpiece is rinsed in de-ionised water at a temperature of between 40° C. and 60° C., and preferably at about 50° C.

Preferably, after activation, the workpiece is introduced into a chromium-plating bath with the current switched off, and the current in the chromium-plating bath is then switched on. In this case, the current in the chromium-plating bath may be increased slowly to a predetermined current density. Advantageously, the current in the chromium-plating bath is increased during about the first 20 to 40 seconds to about half the current density; and then, during about the next 20 to 40 seconds, the current is increased to the predetermined current density of, for example, 50 A/sq.dm.

The invention also provides a hydraulic ram having a piston rod which is provided with a corrosion-proof and wear-resistant coating, wherein the coating is constituted by a currentlessly-applied nickel underlayer and a microcracked covering layer of hard chromium, the nickel layer being of high density, hardness and ductility, and having a thickness which is at least 30 microns, and the microcracked hard chromium layer having a thickness of between 20 and 80 microns.

DESCRIPTION OF PREFERRED EMBODIMENT

The following example illustrates the invention:

The workpieces (piston rods), which are already coated with nickel layers, are introduced into a sulphuric acid bath. After a period of at least 2 minutes, and preferably about 3 minutes, the current is switched on for carrying out cathodic polarisation in the sulphuric acid bath. During the first phase, in which the electric current is not switched on, a surface etching and activation of the nickel layers takes place. During the second phase, that is to say after the current is switched on, the hydrogen forming in the electrolytic sulphuric acid bath reduces the nickel oxide situated on the surface of the nickel layers into pure nickel. This hydrogen may also repel, to a certain extent, any grease or oil adhering to the nickel layers. In this manner, it is possible to increase the adhesion between the subsequently galvanically-applied microcracked hard-chromium coatings and the underlying nickel layers. During the cathodic polarisation in the sulphuric acid bath, a brief current interruption, preferably for a duration of at least 3 to 5 seconds, is effected at least once. During the or each brief current interruption, the sulphuric acid bath is stilled, so that hydrogen can escape. This reduces the possibility of hydrogen diffusing into the nickel layers. Preferably, cathodic polarisation is carried out for about 2 to 3 minutes, then a current interruption is carried out for at least about 3 to 5 seconds, and then a further cathodic polarisation is carried out for about 2 to 3 minutes. This completes the activation of the nickel layers.

After activation, the workpieces are rinsed in deionised water at a temperature of about 40° C. to 60° C., preferably about 50° C., in order to remove all traces of sulphuric acid from the workpieces. The workpieces are then coated with chromium using a conventional plating process. In this operation, it is, however, advisable for the workpieces to be introduced into the electroplating bath with the current switched off, and to switch the current on only after the workpieces have been introduced. This improves the adhesion between the microcracked hard-chromium coatings and the nickel layers. After the introduction of the workpieces into the electroplating bath, the current is increased slowly until it reaches the desired current density, that is to say over a time period of at least 30 to 60 seconds. Preferably, the current is increased to about half the current density (preferably about 25 A/sq.dm.) during the first 20 to 40 seconds; and then, during the next 20 to 40 seconds, to the final current density (preferably about 50 A/sq.dm.).

The invention is further directed to a hydraulic ram, especially a hydraulic pit prop, for use in an underground mine working (or for use under comparable conditions such as, for example, in tunnelling operations) the piston rod of which is provided with a wear-resistant and corrosion-proof protective coating which is produced according to the process described in the above example. In accordance with the invention, the protective coating consists of a nickel layer of high density, hardness and flexibility (ductility) which is applied by means of the known currentless nickel-plating process using sodium hypophosphite as a reducing agent, and has a thickness of between 30 and 60 microns (preferably 30 to 40 microns); and carries a microcracked chromium coating, the thickness of which is between 20 and 80 microns (preferably 30 to 40 microns). The microcracked hard-chromium coating can be applied using the known galvanic hard-plating process.

We claim:

1. A method of applying a corrosion-proof and wear-resistant coating to a workpiece, the method comprising the steps of applying a layer of nickel having a thickness of no more than 60 microns to the workpiece by a currentless nickel-plating process, activating the nickel layer by an electrolytic treatment conducted cathodically in a sulphuric acid bath which has 5 to 20% by volume of sulphuric acid at a temperature of between 25° C. and 60° C. and a current density of between 10 and 60 A/sq.dm., briefly interrupting the application of current during said electrolytic treatment in order to still the sulphuric acid bath so that hydrogen can escape, thereby reducing the possibility of hydrogen diffusing into the nickel layer, and employing a chromium plating process to coat the activated nickel layer with a microcracked chromium coating having a thickness of between 20 and 80 microns.

2. A method according to in claim 1, wherein a hypophosphite is used as a reducing agent during the nickel-plating process.

3. A method according to claim 1, wherein the sulphuric acid bath has about 10% by volume of sulphuric acid.

4. A method according to claim 1, wherein the sulphuric acid is at a temperature of about 50° C.

5. A method according to claim 1, wherein the current density is about 30 to 40 A/sq.dm.

6. A method according to claim 1, wherein the workpiece provided with the nickel layer is introduced into the sulphuric acid bath prior to switching on the current, and wherein the current is switched on for carrying out cathodic polarisation in the electrolytic sulphuric acid bath only after a predetermined time of at least 2 minutes.

7. A method according to claim 6, wherein said predetermined time is about 3 minutes.

8. A method according to claim 7, wherein said at least one interruption of current flow lasts for at least 3 to 5 seconds.

9. A method according to claim 6, wherein, after the current is switched on, cathodic polarisation is carried out for about 2 to 3 minutes, then the current flow is interrupted for between 3 and 5 seconds, and then cathodic polarisation is carried out for about 2 to 3 minutes.

10. A method according to claim 1, wherein, after activation, the workpiece is rinsed in de-ionised water at a temperature of between 40° C. and 60° C.

11. A method according to claim 10, wherein the de-ionised water is at a temperature of about 50° C.

12. A method according to claim 1, wherein, after activation, the workpiece is introduced into a chromium-plating bath with the current switched off, and wherein the current in the chromium-plating bath is then switched on.

13. A method according to claim 12, wherein the current in the chromium-plating bath is increased slowly to a predetermined current density.

14. A method according to claim 13, wherein the current in the chromium-plating bath is increased during about the first 20 to 40 seconds to about half the current density; and then, during about the next 20 to 40 seconds, the current is increased to the predetermined current density.

15. A method according to claim 14, wherein the predetermined current density is 50 A/sq. dm.

16. A method of applying a corrosion-proof and wear resistant coating to a workpiece, the method comprising the steps of: applying a layer of nickel having a thickness of no more than 60 microns to the workpiece by a currentless nickel-plating process; activating the nickel layer electrolytically in a sulphuric acid bath which has 5 to 20% by volume of sulphuric acid at a temperature of between 25° C. and 60° C. and a current density of between 10 and 60 A/sq.dm., the said activation being accomplished by introducing the workpiece into said bath prior to switching on the current, and after a predetermined time of at least 2 minutes, switching on the current to carry out cathodic polarisation for a predetermined time during which the current flow is briefly interrupted at least once; and, employing a chromium plating process to coat the activated nickel layer with a microcracked chromium coating having a thickness of between 20 and 80 microns.

17. A method of applying a corrosion-proof and wear-resistant coating to a workpiece, the method comprising the steps of: applying a layer of nickel having a thickness of no more than 60 microns to the workpiece by a currentless nickel-plating process; activating the nickel layer electrolytically in a sulphuric acid bath which has 5 to 20% by volume of sulphuric acid at a temperature of between 25° C. and 60° C. and a current density of between 10 and 60 A/sq.dm., the said activation being accomplished by introducing the workpiece into said bath prior to switching on the current, then switching on the current for 2 to 3 minutes to carry out cathodic polarisation, interrupting the current flow for a duration of at least 3 to 5 seconds before again switching on the current to continue cathodic polarisation for another 2 to 3 minutes; and employing a chromium plating process to coat the activated nickel layer with a microcracked chromium coating having a thickness of between 20 and 80 microns.

* * * * *